US006196163B1

(12) United States Patent
Shah

(10) Patent No.: US 6,196,163 B1
(45) Date of Patent: Mar. 6, 2001

(54) BOILER FEED WATER HEAT ENERGY SAVER

(76) Inventor: Chandrakant S. Shah, 133 Progress Heights, Gloversville, NY (US) 12078

( * ) Notice: Subject to any disclaimer, the term of this patent is extended or adjusted under 35 U.S.C. 154(b) by 0 days.

(21) Appl. No.: 09/487,653

(22) Filed: Jan. 19, 2000

(51) Int. Cl.[7] ..... F22B 27/00

(52) U.S. Cl. ..... 122/40; 122/414; 122/443; 122/458

(58) Field of Search ..... 122/413, 414, 122/415, 442, 443, 444, 456, 457, 458, 40

(56) References Cited

U.S. PATENT DOCUMENTS 4,177,767 * 12/1979 Regamey ..... 122/456
4,249,486 * 2/1981 Potochnik ..... 122/412
4,878,457 * 11/1989 Bekedam ..... 122/441
5,728,200 * 3/1998 Bekedam ..... 96/158
5,906,800 * 5/1999 Napierkowski et al. ..... 122/40
6,089,013 * 7/2000 Bruckner et al. ..... 60/39.182

* cited by examiner

*Primary Examiner*—Denise L. Ferensic
*Assistant Examiner*—Gregory A. Wilson
(74) *Attorney, Agent, or Firm*—James H. Bower

(57) ABSTRACT

An apparatus for saving boiler feed water heat having a closed condensed water vessel for collecting the steam water condensate from one or more reactor steam jacket, and the steam condensate flash over when it enters the closed vessel due to pressure drop. The closed vessel having a boiler feed water pump located below the vessel and the vessel located below the reactor steam jacket, and cold water injection into the condensate prior to entering the feed water pump. The feed pump then taking the cooled condensed water to the boiler reducing the demand for boiler make up water and saving heat and energy.

9 Claims, 2 Drawing Sheets

BOILER FEED WATER HEAT ENERGY SAVER

BACKGROUND OF THE INVENTION

In the chemical industry and other process industries using steam for steam jacketed reactors, heat is lost by either a throw away or collecting the condensed water at atmospheric pressure in an uninsulated make-up water tank. It then mixes with room temperature make-up water which is pumped into the boiler as feed water by a feed water pump.

As a result of the above process, part of the steam condensate, which is at higher pressure than atmospheric, flash over into steam due to pressure drop. The flash steam is lost into atmosphere and also the heat it carries. If an open feed water tank is used and condensate pipes are not insulated between the reactor and tank, condensate heat will also leak out into the atmosphere.

SUMMARY OF THE INVENTION

The present invention relates to an apparatus and method to save the lost heat energy of the condensate and send it back to the boiler as boiler feed water.

This is accomplished by collecting the high temperature steam condensate from the reactor steam jacket into a closed vessel in which the pressure is that of the lowest pressure in the reactor steam jacket. This pressure will be higher than atmospheric.

Since the pressure in the steam jacket and closed vessel are equal, there will be little or no steam flash over due to pressure drop. The closed vessel with steam condensate is then fed into the boiler. The amount of heat saving to the boiler is the amount of flash over steam saved and hotter condensate returned to the boiler by this method and apparatus.

Also, the heat leakage into the atmosphere from the condensed water vessel and the pipelines is reduced to minimum by insulating them.

The high temperature condensate in the closed water vessel is sent to the boiler by the feed pump, however, the condensate is at its saturation temperature so any pressure drop in the pipes joining the vessel to the fed pump will permit condensate to flash over into steam in the pipeline or at the feed pump suction intake and stop the feed pump.

To avoid the flash steam at the feed pump suction, a water head or gravity head is provided by keeping the closed water vessel at a higher level than the pump to provide a net positive suction head.

Also, steam flash over in the pump and pipe lines may be avoided by reducing the water temperature below its saturation temperature by mixing the condensate water with colder make-up water. This mixing is by way of a cold water injector mounted in the pipe line before the condensate enters the feed pump to bring the temperature of the condensate lower than its saturation temperature.

In a multi-reactor plant, where steam jackets may have different jacket pressures, the same general system may be used.

DESCRIPTION OF THE PREFERRED EMBODIMENT

Figure 1:
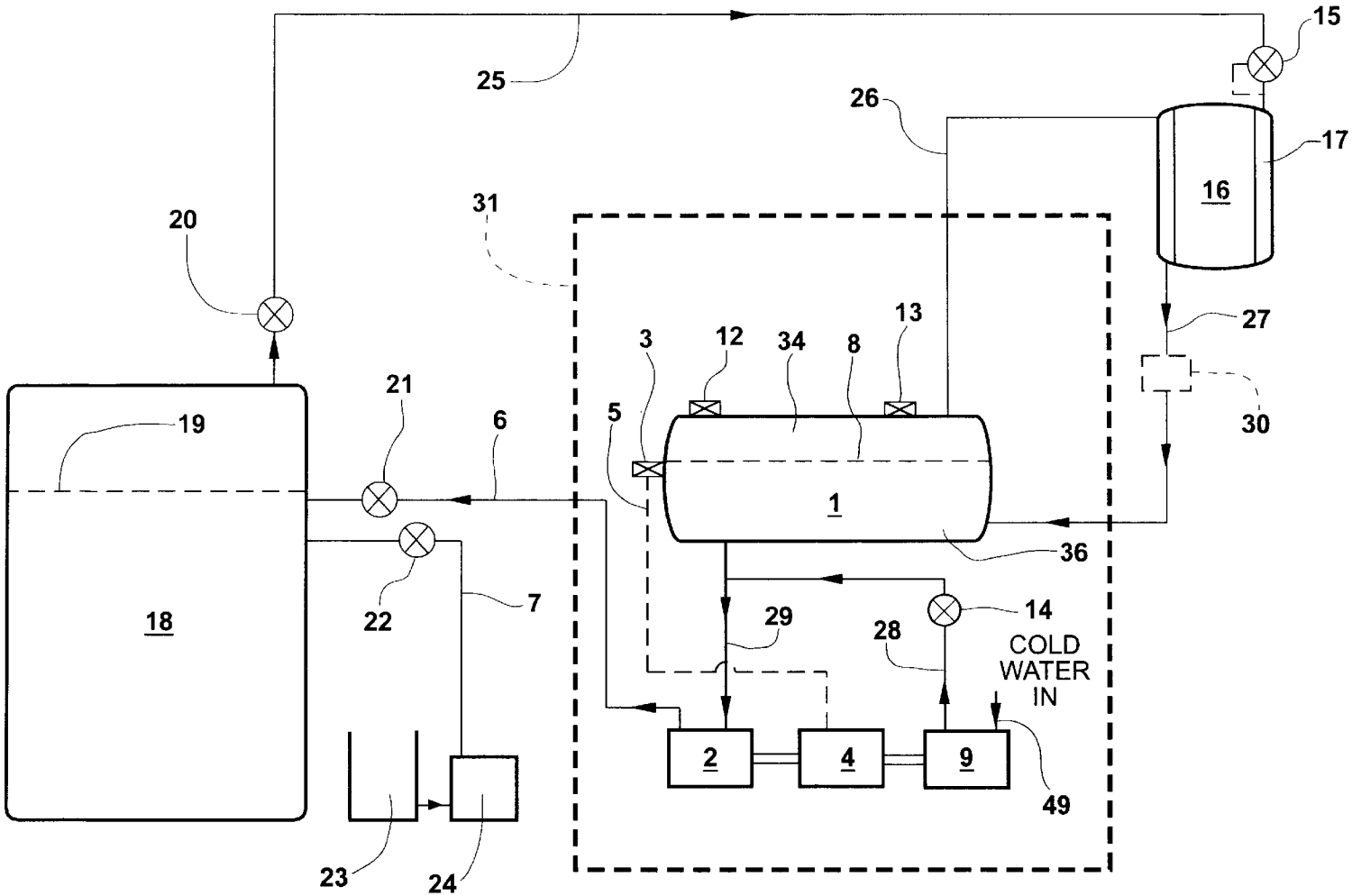
FIG. 1 is a diagrammatic and schematic circuit diagram of an embodiment of the invention with a single reactor.

Referring to the drawing, FIG. 1, a closed condensed water vessel 1 is connected by pipe line 27 to steam jacket 17 off reactor 16, where condensed water is transferred into vessel 1. Also, vessel 1 is connected by pipe 26 above water line 8, to top off steam jacket 17.

Closed water vessel 1 has a water level control switch 3 to maintain the water level 8 by turning feed water pump motor 4 on and off through control line to start and stop feed pump 2 which pumps condensed water from vessel 1 to boiler 18 by way of pipe line 6 and feed water check valve 21. When the water level 8 falls below the required level, feed water pump 2 stops.

The unit shown in FIG. 1 within the heavy dotted lines 31 is mounted below the steam jacket 17 to allow the flow of condensate, due to gravity, to flow directly into vessel 1 through pipe line 27 and steam trap 30.

All pipe lines from reactor 16 to the boiler 18 are heavily insulated to prevent heat leakage from the condensed water. Also, vessel 1 is provided with safety valve 12 against over pressure and vacuum break valve 13 to allow air to enter vessel 1 and break the vacuum.

Feed pump 2 is mounted directly below vessel 1 at a height to provide net positive suction to avoid steam flash over in feed pump 2 due to suction. The pipe line 27 is also kept under gravity head to prevent flash over from the condensed water as it enters vessel 1.

The condensed water in vessel 1 is at its saturation temperature and any pressure drop in pipe line 29 to the feed pump 2 suction inlet may cause part of the condensate to flash over into steam and stop water pumping through pump 2. By increasing the pressure at feed pump 2 suction inlet with a water head by keeping vessel 1 at a higher level than feed pump 2, a net positive suction head is maintained.

The steam flash over in feed pump 2 and pipe 29 may also be avoided by reducing the condensed water temperature into pipe line 29 below its saturation temperature. This is done by mixing the condensed water with colder make-up water.

The colder make-up water enters cold feed water pump 9 from cold water pipe 49 and enters outlet pipe 28 and check valve 14 to enter pipe line 29 to mix with the high temperature condensate coming from vessel 1.

This mixing may also be carried out by a water injector mounted in pipe 28 and 29 junction prior to entering feed pump 2.

FIG. 1 also shows the standard boiler make-up water tank 23 and pump 24 having pipe line 7 and feed line check valve 22 to boiler 18 with water level 19. Boiler 18 outlet pipe line 25 has steam stop valve 20 and pressure regulating valve 15.

Make-up water for boiler 18 is not used from tank 23 unless sufficient make-up water cannot be obtained from condensed water vessel 1.

Figure 2:
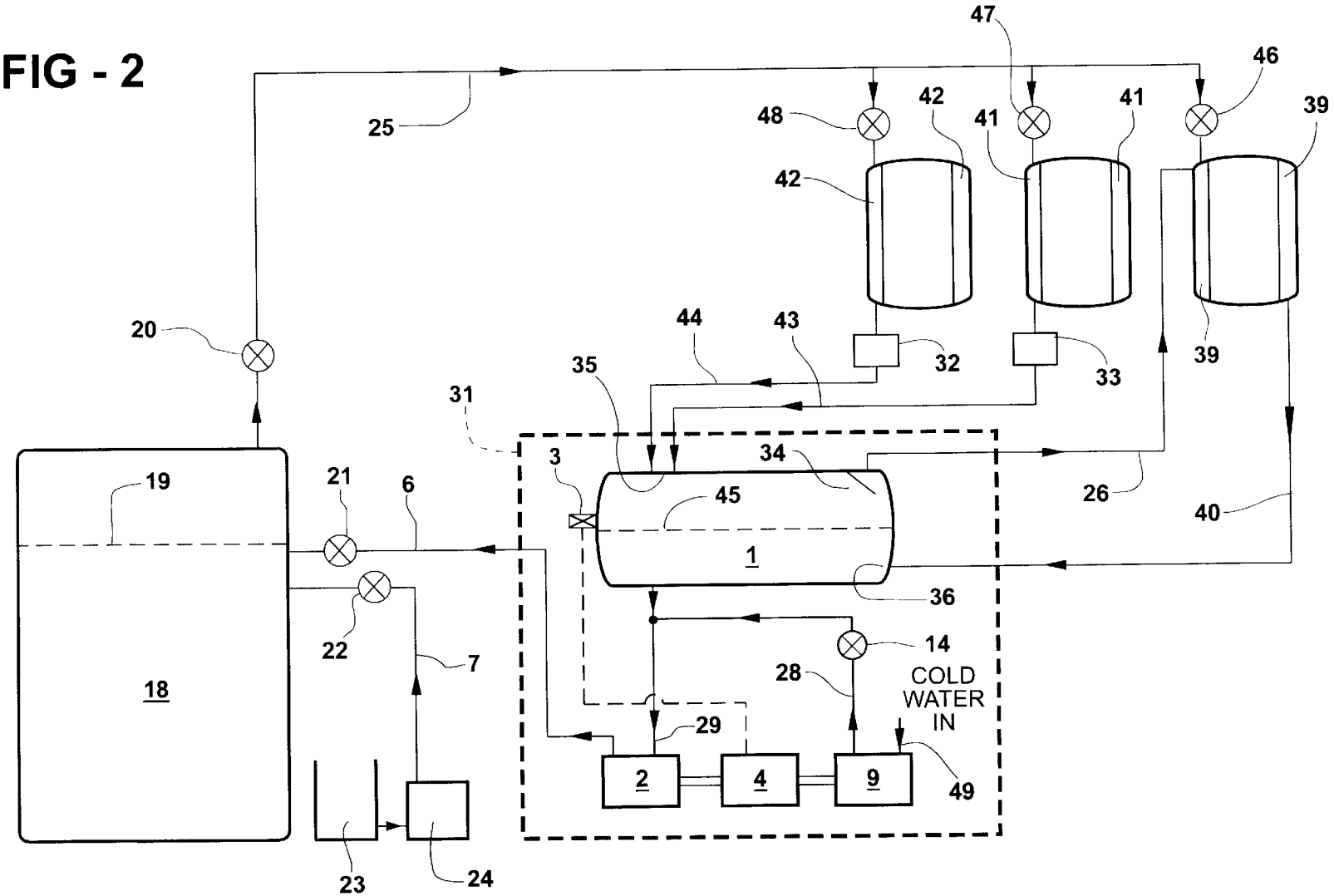
FIG. 2 is a schematic circuit diagram of an embodiment of the invention having a multi-reactor system.

FIG. 2 is an embodiment of the invention having a multi-reactor system which is supplied with steam from the same boiler and having steam jackets of different pressure, note pressure regulating valves 46, 47, and 48 with valve 46 having the lowest pressure setting.

In FIG. 2, vessel 1 is connected directly by pipe line 40 to steam jacket 39, which has the least operating pressure, and the other end of pipe 40 to vessel 1 at space 37 near the bottom of vessel 1 to carry condensed water by gravity.

Reactor steam jackets 41 and 42, FIG. 2, are operating at a higher pressure than reactor steam jacket 39, and have respective steam traps 33 and 32 and pipe lines 43 and 44 to carry condensed water to steam space 35 at the top of vessel 1 and above water level 45.

As the condensed water enters steam space 35, where the high pressure condensate flashes partly into steam and remaining condensate comes to saturation temperature that corresponds to the temperature and pressure of vessel 1, and remains in vessel 1 as condensate.

The high pressure condensate that flashes into steam in steam space 35 passed out of vessel 1 through steam separator 38 and pipe line 26 to the top of steam jacket 39, which has the least pressure of the three reactor steam jackets.

This flash steam may then be used as energy in the reactor steam jacket 39. The condensate from jacket 39 is then returned to vessel 1 by pipe line 40 in water space 37, and the condensed water collected from all three reactors may be pumped by feed water pump 2 to boiler 18, and reduce the demand for boiler makeup water 23 and pump 24.

What is claimed is:

1. An apparatus to collect boiler high temperature flash steam condensate and heat in a reactor steam jacket having a feed pump to transfer said condensate comprising:

a closed vessel in which the internal pressure maintained is the same as that maintained in said steam jacket;

vessel pipes for receiving high temperature steam condensate and flash steam from said steam jacket;

said vessel receiving the condensate located at a lower level than the steam jacket to maintain the condensate flow by gravity, and said vessel located above condensate feed pump to maintain a required net positive suction head;

and means for maintaining a water level in said vessel to allow space to receive flash steam; and vessel discharge pipe below said water level communicating with a feed water pump to discharge condensate as boiler feed water.

2. The apparatus according to claim 1 including, reducing the temperature of condensate in said vessel discharge pipe by mixing condensate with cold make up water.

3. The apparatus of claim 2, including mixing by means of a water injector prior to condensate entering said feed pump.

4. The apparatus of claim 3 including a cold water injector pump, said pump having a common electrical drive motor with the feed water pump.

5. A device to collect boiler feed water and heat in a multi-reactor system having a common boiler with a common feed water pump and steam jackets of different pressure comprising:

a closed vessel having a fixed water level in which the internal pressure maintained is that of the lowest pressure maintained in the steam jacket of said multi reactor system;

the low pressure jacket receiving steam from the top of said vessel and returning condensate below said water level;

the steam jackets of higher pressure returning steam and condensate to the top of said vessel above said water level, said vessel located at a lower level than the steam jackets to maintain a net positive suction head at said common feed water pump located below said vessel to discharge condensate to said common boiler.

6. The apparatus according to claim 5 including, reducing the temperature of condensate in said vessel prior to entering said feed water pump by mixing condensate with colder make up water.

7. The apparatus according to claim 6, including mixing said condensate water by means of a cold water injector prior to condensate entering said feed pump.

8. The apparatus according to claim 7 including a cold water injector pump, said pump having a common electrical drive motor with the feed water condensate pump.

9. A method to collect boiler steam condensate and flash over steam in a reactor steam jacket system having a boiler water tank, feed water pump and closed condensate vessel comprising:

1. maintaining the internal pressure of said vessel at the same pressure of said steam jacket;
2. receiving steam, steam flash over and condensate into said vessel;
3. maintaining a water level in said closed vessel;
4. maintaining above said water level, space to receive steam and flash over;
5. locating the closed vessel below said steam jacket to assure a gravity flow of condensate;
6. locating the closed vessel above said feed water pump to maintain required net positive suction head; and
7. starting and stopping said pump to discharge condensate into the boiler.

* * * * *